US005079935A

United States Patent [19]

Zaucha

[11] Patent Number: 5,079,935

[45] Date of Patent: Jan. 14, 1992

[54] TRAPPED KEY LOCK MECHANISM

[76] Inventor: John A. Zaucha, 3011 N. Menard, Chicago, Ill. 60634

[21] Appl. No.: 565,042

[22] Filed: Aug. 9, 1990

[51] Int. Cl.[5] ..... E05B 11/02

[52] U.S. Cl. ..... 70/140; 70/162; 70/232; 70/389; 70/454; 70/DIG. 57; 292/251; 411/407

[58] Field of Search ..... 70/DIG. 57, DIG. 47, 70/454, 389, 390, 441, 453, 229, 232, 159-162, 140, DIG. 14, DIG. 38; 292/251; 411/407, 544, 552-554

[56] References Cited

U.S. PATENT DOCUMENTS

| | | | |
|---|---|---|---|
| 188,112 | 3/1877 | Ekerman | 292/251 |
| 780,951 | 1/1905 | Kulhanek | 292/251 |
| 1,480,338 | 1/1924 | Bacon | 292/251 |
| 1,784,551 | 12/1930 | Smith | 70/168 |
| 1,788,118 | 1/1931 | Meyer | 70/168 |
| 3,222,899 | 12/1965 | Bodoh et al. | 292/251 |
| 3,299,678 | 1/1967 | Spencer | 292/251 |
| 3,444,712 | 5/1969 | Greenwald | 70/454 |
| 3,494,159 | 2/1970 | Greenwald | 70/454 |
| 3,798,935 | 3/1974 | Blekking et al. | 70/389 X |
| 3,855,824 | 12/1974 | Falk | 70/38 A |
| 4,073,165 | 2/1978 | Grundstrom et al. | 70/371 |
| 4,147,905 | 4/1979 | Scherbing | 70/491 X |
| 4,337,987 | 7/1982 | Brooks et al. | 312/219 |
| 4,686,874 | 8/1987 | McCauley et al. | 292/251 X |

FOREIGN PATENT DOCUMENTS

| | | | |
|---|---|---|---|
| 2817251 | 11/1978 | Fed. Rep. of Germany | 411/533 |
| 2106981 | 4/1983 | United Kingdom | 70/389 |

*Primary Examiner*—Lloyd A. Gall
*Attorney, Agent, or Firm*—Lee, Mann, Smith, McWilliams & Sweeney

[57] ABSTRACT

A lock operable by a key between a locked condition and an open condition, the lock having a fastener for releasably securing the lock to an object, the fastener being movable between a retracted position wherein the lock is in the open condition and an extended position, a spring for biasing the fastener to the retracted position and an enclosure having an opening adapted to allow the insertion and removal of the key from the lock when the lock is in the locked condition and to prevent the removal of the key from the lock when the lock is in an unlocked condition.

8 Claims, 2 Drawing Sheets

TRAPPED KEY LOCK MECHANISM

BACKGROUND OF THE INVENTION

The present invention relates to locks which are operable by a key between locked and unlocked conditions and in particular to locks wherein once the key is used to place the lock in an unlocked condition the lock prevents removal of the key from the lock until the lock is returned to a locked condition.

Utility services such as electric service, telephone service and cable television service are commonly provided to residential and commercial users. In providing these services enclosures such as utility boxes are used to enclose the electrical and other equipment needed to provide the service. For example, in an apartment complex each apartment's cable television hook-up will be located in a common utility box.

Utility boxes are normally locked so that only authorized servicemen will have access to the contents. A problem has arisen however in that the servicemen, which are often times subcontractors of the utility provider, will leave the utility boxes unlocked after completing their work and may not even close the utility box door. When the utility box is left open, cable lines and other electrical equipment are left exposed whereby they may be easily damaged and may injure children and others. Even where the utility box is closed, but left unlocked, anyone may have access to the utility box which not only creates the hazard of potential injury, but most commonly encourages and enables the theft of the utility service by an unauthorized user. In the example of an apartment complex, all apartments are normally wired for cable television service. All that is needed to provide the cable service to a particular apartment is to make the proper hook-up in the utility box. When the box is left unlocked, the apartment dweller may easily make this hook-up himself without the knowledge of the cable company, thereby obtaining free and unauthorized cable television service. Similar problems are also encountered with cabinets, vending machines and any other enclosures which are intended to have limited access to only authorized personnel.

It has therefore been found desireable to provide a lock which requires a key to unlock the enclosure, whereby once the lock is unlocked the lock will trap the key within the lock preventing the removal of the key until the enclosure is securely closed and the lock is returned to a locked condition. A serviceman will therefore be required to close and lock the enclosure before he can remove his key. The enclosure keys may be issued and returned daily to the owner of the enclosures so that the owner may monitor whether any keys are being left in enclosures and by whom.

SUMMARY OF THE INVENTION

The present invention provides a lock which is operable by a key between locked and unlocked conditions. The lock is generally attached to a cover to releasably secure the cover to a box. The lock includes a fastener which is releasably fastenable to the box. The fastener is movable between an extended position wherein the fastener may be attached to the box and a retracted position wherein the fastener is not attached to the box and the lock is in an unlocked condition. A spring biases the fastener to its retracted position. The lock includes an aperture which allows the axial insertion of the key into the lock to a first position and allows a subsequent lateral movement of the key to a second position where the key may engage the fastener, but may not be axially withdrawn from the lock.

As the key is used to unlock the lock, the fastener begins to move from its fully extended position towards its retracted position. Once the fastener leaves its fully extended position, the fastener will prevent the key from being moved laterally from the key's second position to key's first position. The key is thereby prevented from both lateral movement and axial withdrawal from the lock and is trapped within the lock. When the lock is returned to its locked condition, the fastener will be returned to its fully extended position and the key may then be moved laterally to its first position and thereafter axially withdrawn from the lock.

DESCRIPTION OF THE PREFERRED EMBODIMENT

Figure 2:
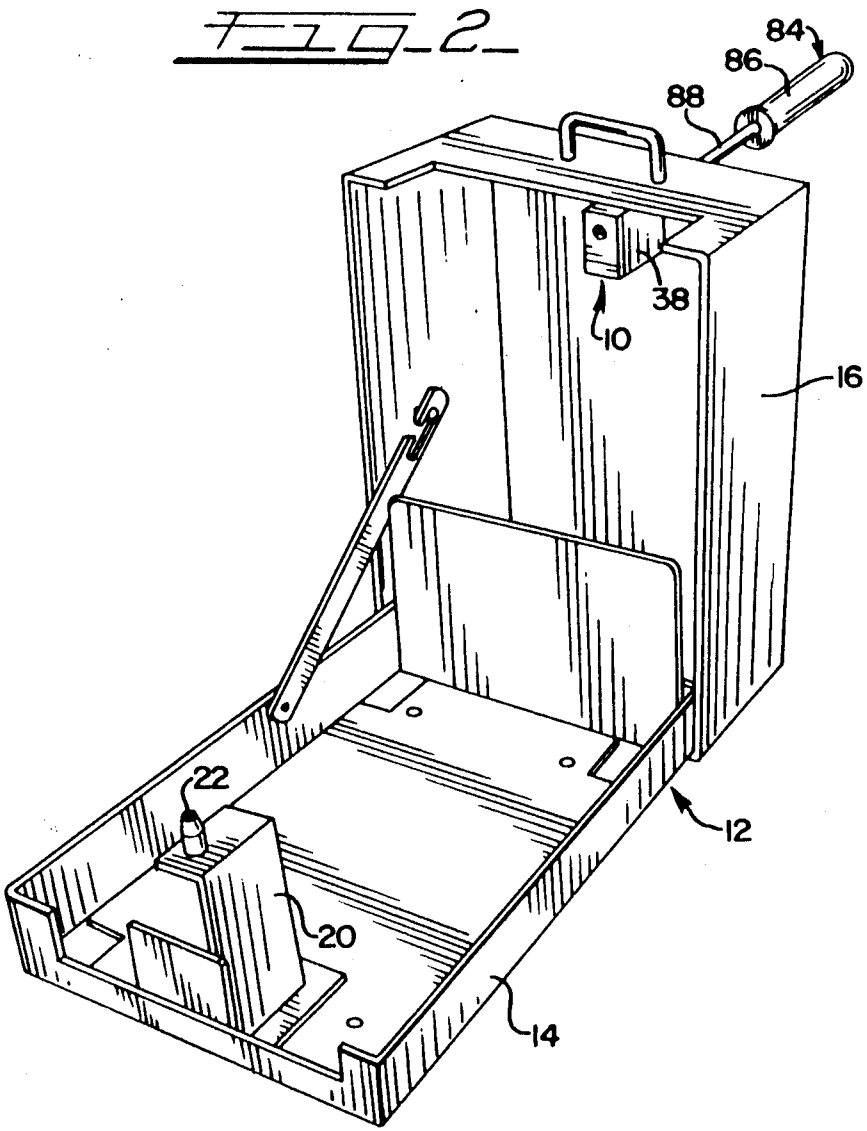
FIG. 2 is a perspective view of a box containing the lock of the present invention shown in an unlocked condition with a key shown trapped within the lock.
Figure 1:
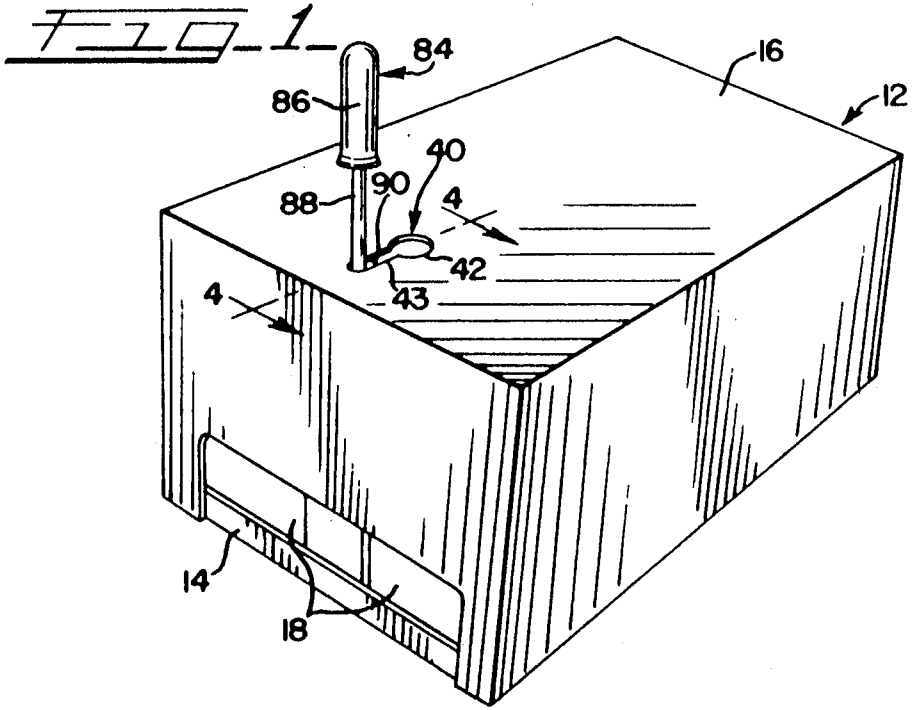
FIG. 1 is a perspective view of a box containing the lock of the present invention shown in a locked condition with a key removably inserted into the lock.

The lock mechanism 10 is shown in use with a box 12 having a rear panel 14 and a door 16. The box 12 shown here is a typical cable television utility box, however the lock mechanism 10 may be used with any apparatus or enclosure which has a door, lid or cover which is intended to be operated between open and closed positions. The panel 14 is shown in a horizontal position although in practice the panel 14 is generally vertical and is normally fastened to a utility pole or a wall. FIG. 1 shows the box 12 in a closed position with the lock 10 in a locked condition. When in the closed position, cables enter and exit the box 12 through openings 18 formed between the door 16 and the panel 14. FIG. 2 shows the box 12 in an open position with the lock 10 in an unlocked condition. The door 16 is pivotally connected to the panel 14 by a hinge or similar type of means. A plate 20 is connected to and extends from the panel 14. A nipple 22 is attached to the end of the plate 20. The nipple 22 includes a conical shaped end 24 and a threaded aperture 26 which extends into the conical end 24.

Figures 3, 4, 5:
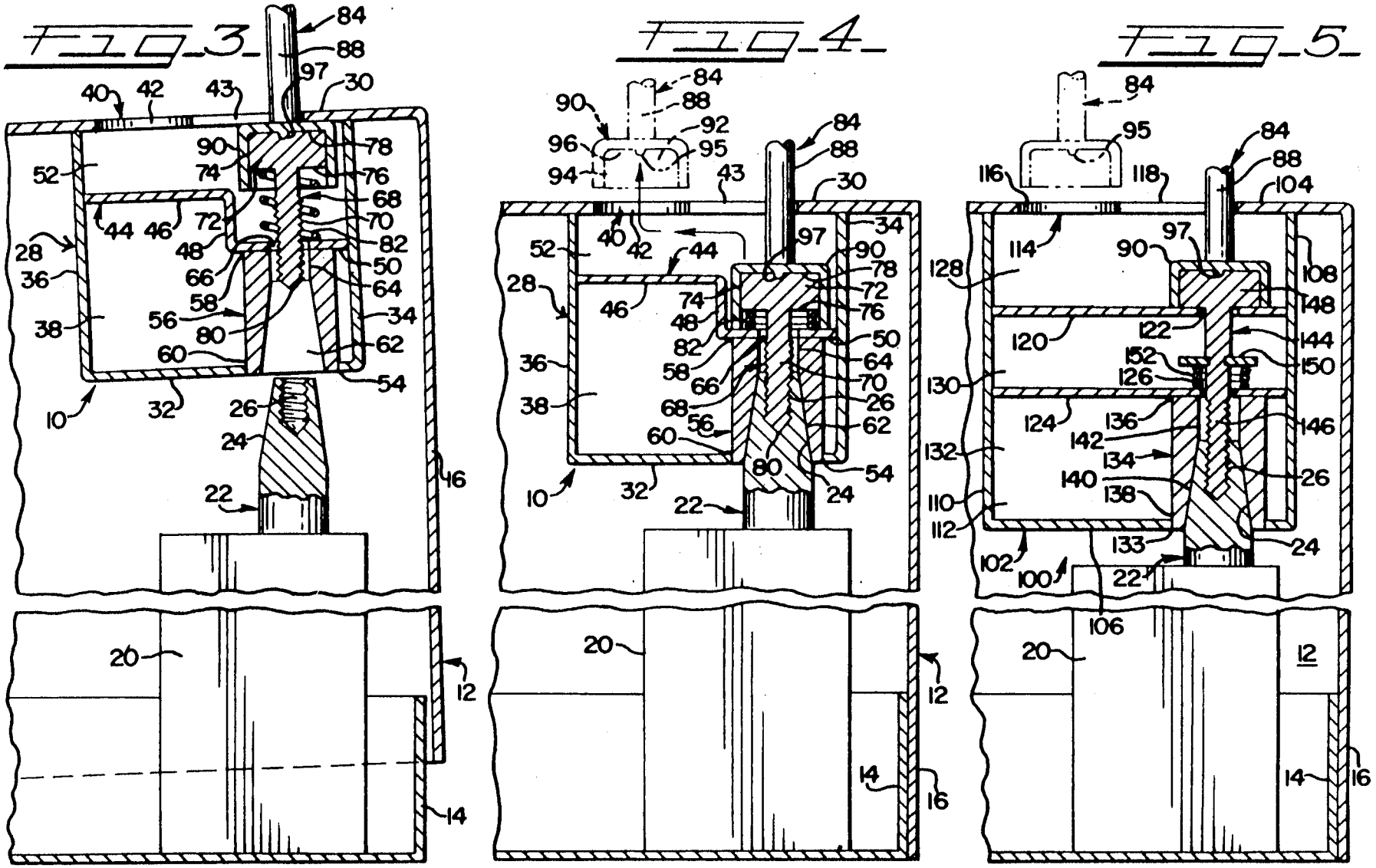
FIG. 3 is a partial cross-sectional view of a first embodiment of the lock shown in an unlocked condition with a key trapped within the lock.
FIG. 4 is a partial cross-sectional view of the first embodiment of the lock shown in a locked condition with a key shown inserted into the lock, but in a removable condition.
FIG. 5 is a partial cross-sectional view of a second embodiment of the lock shown in a locked condition with a key shown inserted into the lock, but in a removable condition.

As best shown in FIGS. 3 and 4 the lock 10 is connected to the door 16. The lock 10 includes a generally rectangular enclosure 28 which includes a front wall 30, a rear wall 32, a top wall 34, a bottom wall 36 and a pair of sidewalls 38. As shown in FIGS. 3 and 4, the front wall 30 of the lock 10 comprises a portion of the door 16, however the front wall 30 may be a separate component from the door 16. The front wall 30 includes a keyhole 40 as best shown in FIG. 1. The keyhole 40 includes a circular aperture 42 and a slot 43 which extends from the aperture 42. The aperture 42 need not be circular and may be of various other configurations. The slot 43 is narrower than the width of the aperture 42.

A partition 44 is located within the enclosure 28 and extends from the bottom wall 36 to the top wall 34 and between the sidewalls 38. The partition 44 is in a generally Z-shaped configuration having a first leg 44 extending perpendicular to the bottom wall 36, a second leg 48 extending perpendicular to the first leg 44, and a third leg 50 extending perpendicular to the second leg 48 and connected to the top wall 34. The partition 44 may also have a planar configuration, however the Z-shaped configuration is preferred as it deters tampering with the lock components. The partition 44 creates a chamber 52 within the enclosure 28 between the partition 44 and the front wall 30.

The rear wall 32 of the enclosure 28 includes an aperture 54. A guard 56 having a first end 58 and a second end 60 is located within the enclosure 28. The first end 58 of the guard 56 is attached to the third leg 50 of the partition 44. The second end 60 of the guard 56 extends into the aperture 54 and is attached to the rear wall 32 of the enclosure 28. The guard 56 includes a conical chamber 62 extending inward from the second end 60 and a cylindrical chamber 64 extending inward from the first end 58. The cylindrical chamber 64 is axially aligned with and connected to the conical chamber 62. The third leg 50 of the partition 44 includes an aperture 66 which is axially aligned with the cylindrical chamber 64 of the guard 56. The conical chamber 62, the cylindrical chamber 64 and the aperture 66 provide a passageway from the exterior of the rectangular enclosure 28 to the chamber 52 within the enclosure 28. The conical chamber 62 tapers outward from the cylindrical chamber 64 and is adapted to receive the conical end 24 of the nipple 22 in close fitting engagement, as best shown in FIG. 4. The lock 10 is positioned on the interior of the door 16 in such a position that as the door 16 is moved to the closed position the nipple 22 will fit securely within the conical chamber 62.

A fastener 68 is provided within the lock 10 to releasably secure the conical end 24 of the nipple 22 within the conical chamber 62 of the guard 56, thereby releasably securing the door 16 to the panel 14 in a locked condition. The fastener 68 includes a threaded shaft 70 which extends from a head 72. The head 72 includes a sidewall 74 which extends around the perimeter of the head and between a lower surface 76 and an upper face 78. The threaded shaft 70 of the fastener 68 is adapted to be threadably inserted into the threaded aperture 26 of the nipple 22 for securement thereto. The threads on the threaded shaft 70 and within the threaded aperture 26 may be either left or right hand threads. The threaded shaft 70 includes a tip 80. The length of the shaft 70 is such that the tip 80 will not extend beyond the rear wall 32 of the enclosure 28. The sidewall 74 of the head 72 may be in one of any different geometric shapes such as circular, square or hexagonal.

A spring 82 is located concentrically around the shaft 70 of the fastener 68 and extends between the lower surface 76 of the head 72 and the third leg 50 of the partition 44. The spring 82 biases the fastener 68 from a fully extended position shown in FIG. 4 to a retracted position as shown in FIG. 3 wherein the shaft 70 is substantially withdrawn from the conical chamber 62. The spring 82 is of sufficient length to be capable of biasing the fastener 68 to a position wherein the face 78 of the head 72 will abut the front wall 30 of the lock 10. When the fastener 68 is in a retracted position as shown in FIG. 3, a portion of the shaft 70 will extend into the cylindrical chamber 64 to prevent lateral movement of the fastener 68 within the chamber 52.

A key 84 includes a handle 86 and a shaft 88 extending therefrom. A socket 90 is connected to the end of the shaft 88. The socket 90 defines a hollow chamber 92 having a sidewall 94 and a top wall 96. The chamber 92 of the socket 90 is adapted to receive the head 72 of the fastener 68. The sidewall 94 of the chamber 92 is configured to fit closely around the sidewall 74 of the head 72. The socket 90 of the key 84 permits the key 84 to be axially inserted over the head 72 of the fastener 68 so that the key 84 is rotationally connected to the fastener 68. The key 84 and the fastener 68 may be rotationally connected by one of various different means such as by the use of rectangular or hexagonal sidewalls 74 and 94. Alternatively, the top wall 96 of the socket 90 may include a raised pattern 95 which is adapted to fit within a correspondingly depressed pattern 97 in the face 78 of the head 72 to provide a rotational connection. The sidewall 74 of the socket 90 is preferably only slightly shorter than the distance between the front wall 30 and the face 78 of the fastener head 72 as measured when the fastener 68 is in its fully extended position as shown in FIG. 4. This prevents lateral movement of the key 84 within the chamber 52 until the fastener 68 is returned to its fully extended position.

In operation, starting from the lock 10 being in an open condition as shown in FIG. 3, the door 16 is moved to a closed position over the panel 14 wherein the conical end 24 of the nipple 22 is located within the conical chamber 62 of the lock 10. The key 84 is pushed axially downward, simultaneously compressing the spring 82, until the tip 80 of the threaded shaft 70 abuts the threaded aperture 26 of the nipple 22. The key 84 is then rotated about the longitudinal axis of the shaft 88 in the appropriate direction such that the threaded shaft 70 will be threadably inserted into the threaded aperture 26 of the nipple 22. The fastener 68 continues to be rotated by the key 84 until the spring 82 is completely compressed and the nipple 22 is securely drawn into the conical chamber 62 as shown in FIG. 4. The key 84 may then be axially withdrawn from the head 72 of the fastener 68. Once the socket 90 is removed from the head 72, the key 84 may be moved laterally along the slot 43 to the circular aperture 42. The key 84 may then be axially withdrawn from the chamber 52 to a position a shown in phantom in FIG. 4. The box 12 is thus left in a securely closed and locked condition.

To unlock the lock 10 and open the box 12, the socket 90 of the key 84 is axially inserted through the circular aperture 42 in the front wall 30 and into the chamber 52 of the lock 10. The key 84 is then laterally moved to a position over the fastener 68 with the shaft 88 traveling along the slot 43 in the front wall 30. The key 84 is then further inserted axially so that the head 72 of the fastener 68 fills the chamber 92 of the socket 90. The key 84 is then rotated about the longitudinal axis of the shaft 88 to provide the proper rotation of the fastener 68 such that the fastener 68 is threadably removed from the nipple 22. As the fastener 68 is unthreaded from the nipple 22, the head 72 will move towards the front wall 30 of the lock 10. Once the fastener 68 is unthreaded from the nipple 22 the spring 82 will bias the head 72 toward the front wall 30 such that the socket 90 cannot be removed from the fastener 68 and is thereby trapped within the chamber 52 between the fastener head 72 and the front wall 30. The key 84 will remain trapped in the lock 10 until the door 16 is securely closed and the lock 10 is returned to the locked condition. Even while in the open condition, if the key 84 is used to axially push the fastener 68 to its fully extended position the tip 80 of the threaded shaft 70 will not extend beyond the rear wall 32 so that the fastener 68 may not be manually held in the extended position to permit the removal of the key 84.

A modified embodiment of the present invention is shown in FIG. 5 as lock mechanism 100. The lock 100 includes a generally rectangular enclosure 102 which includes a front wall 104, a rear wall 106, a top wall 108, a bottom wall 110 and a pair of sidewalls 112. As shown in FIG. 5, the front wall 104 comprises a portion of the door 16, however the front wall 104 may be a separate component from the door 16. The front wall 104 includes a keyhole 114 which includes a circular aperture 116 and a slotted aperture 118 substantially as shown with the keyhole 40. A first partition 120 extends perpendicularly between the top wall 108, the bottom wall 110 and the sidewalls 112. The first partition 120 includes an aperture 122. A second partition 124 is parallel to the first partition 120 and extends between the top wall 108, the bottom wall 110 and the sidewalls 112. The second partition 124 includes an aperture 126. The first partition 120 and the second partition 124 are spaced apart from one another creating a first chamber 128, a second chamber 130 and a third chamber 132 within the enclosure 102.

The rear wall 106 includes an aperture 133. A guard 134 having a first end 136 and a second end 138 is located within the chamber 132. The first end 136 of the guard 134 is attached to the partition 124. The second end 138 of the guard 134 extends into the aperture 133 and is attached to the rear wall 106 of the enclosure 102. The guard 134 includes a conical chamber 140 extending inward from the second end 138 and a cylindrical chamber 142 extending inward from the first end 136. The conical chamber 140, the cylindrical chamber 142 and the apertures 126 and 133 provide a passageway from the exterior of the rectangular enclosure 102 to the chamber 130 within the enclosure 102.

A fastener 144 includes a shaft 146 which extends from a head 148. The shaft 146 may be partly or completely threaded. The shaft 146 of the fastener 144 extends through the apertures 122 and 126 of the partitions 120 and 124. The fastener 144 additionally includes a platform 150 which is attached to and extends perpendicularly from the shaft 146. The platform 150 is located within the chamber 130. A spring 152 is located concentrically around the shaft 146 of the fastener 144 and extends between the platform 150 and the second partition 124. The spring 152 biases the platform 150 and the associated fastener 144 to a retracted position.

The lock 100 operates in the same manner as the lock 10. When the lock 100 is in a locked condition, as shown in FIG. 5, the key 84 may be axially withdrawn from the fastener 148, moved laterally to the circular aperture 116 and then be further axially withdrawn from the chamber 128 and the lock 100. The use of the platform 150 and the first partition 120 provides greater security to the lock 100 making it practically impossible to disable the spring 152 from the exterior of the lock 100.

Various features of the invention have been particularly shown and described in connection with the illustrated embodiments of the invention, however, it must be understood that these particular arrangements merely illustrate, and that the invention is to be given its fullest interpretation within the terms of the appended claims.

What is claimed is:

1. A lock operable by a key, said key being insertable into said lock for operating said lock between a locked condition wherein said lock is releasably secured to an object and an unlocked condition wherein said lock is released from said object, said lock comprising:

locking means for releasably securing said lock to said object, said locking means being movable between a retracted position wherein said lock is in the unlocked condition and an extended position;

biasing means for biasing said locking means to said retracted position; and trap means for preventing the removal of said key from said lock when said locking means is in the retracted position, said trap means allowing the removal of said key from said lock when said locking means is in said extended position, wherein said locking means comprises: a shaft having a first end and a second end; first connector means attached to said first end of said shaft for removably securing said shaft to said object; second connector means attached to said second end of said shaft for rotationally attaching said key to said shaft.

2. The lock of claim 1 wherein said biasing means comprises a spring.

3. The lock of claim 1 wherein said first connector means comprises threads formed around said shaft.

4. The lock of claim 1 wherein said second connector means comprises a head.

5. The lock of claim 4 wherein said head includes a depressed pattern which matingly engages said key.

6. The lock of claim 1 wherein said trap means comprises an enclosure having an aperture for the insertion and lateral movement of said key.

7. The lock of claim 6 wherein said aperture includes a circular portion and a slotted portion.

8. The lock of claim 1 additionally comprising guard means for preventing said locking means from being manually held in said extended position while said lock is in said unlocked condition.

* * * * *